United States Patent [19]

Latassa

[11] 4,114,968

[45] Sep. 19, 1978

[54] METHOD OF PROCESSING FLUORESCENT LAMP

[75] Inventor: Frank M. Latassa, Magnolia, Mass.

[73] Assignee: GTE Sylvania Incorporated, Danvers, Mass.

[21] Appl. No.: 673,823

[22] Filed: Apr. 5, 1976

[51] Int. Cl.[2] ..... H01J 9/12

[52] U.S. Cl. ..... 316/1; 29/25.17

[58] Field of Search ..... 316/19, 22, 26, 17, 316/1, 27; 29/25.11, 25.17

[56] References Cited

U.S. PATENT DOCUMENTS

| | | | |
|---|---|---|---|
| 2,489,261 | 11/1949 | Braunsdorff | 316/19 |
| 3,817,591 | 6/1974 | Deiss | 316/19 |

*Primary Examiner*—Richard B. Lazarus

*Attorney, Agent, or Firm*—James Theodosopoulos

[57] ABSTRACT

In a rapid start fluorescent lamp having a switch on the cathode mount to discontinue heater current flow after lamp ignition, a fuse is provided to short out the switch during lamp processing. After the electrode activation step in the process, the fuse is melted to render the switch operative.

5 Claims, 1 Drawing Figure

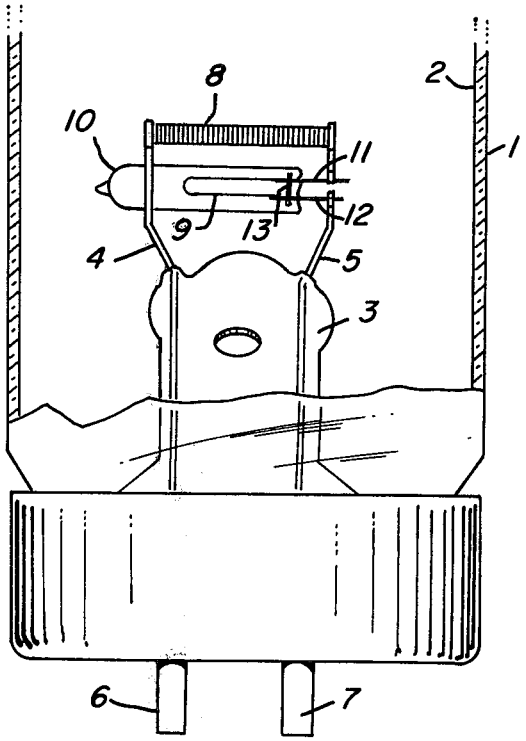
8
2
10
1
11
12
9
13
4
5
3
6
7

METHOD OF PROCESSING FLUORESCENT LAMP

THE INVENTION

This invention concerns fluorescent lamps and especially rapid start lamps. A fluorescent lamp is a low pressure arc discharge lamp having an elongated glass envelope with a phosphor coating on the inner wall thereof, containing an inert gas and a small amount of mercury and having an electrode at each end.

In a copending application, Ser. No. 673,822, entitled "Fluorescent Lamp Containing A Cathode Heater Circuit Disconnect Device", filed on Apr. 5, 1976, same assignee, and identified by attorney docket number D-7503, there is disclosed a rapid start fluorescent lamp having a switch proximate the lamp electrode in order to stop heater current flow after lamp ignition. The switch opens after lamp ignition as a result of being heated by the electrode.

This invention is concerned with the processing of such a lamp having such a switch.

The single FIGURE in the drawing is an elevational view, partly in section, of one end of a fluorescent lamp at one stage of the process of this invention.

As shown in the drawing, the lamp comprises a glass envelope 1 having a phosphor 2 thereon. A glass stem mount 3 is sealed to the end of envelope 1. Embedded in and extending through mount 3 are lead-in wires 4 and 5 which are connected to external pins 6 and 7 respectively. A coiled electrode 8 is connected to and supported on the upper end of lead-in wire 4. Electrode 8 is the usual type of electrode used in rapid start fluorescent lamps and is sometimes called a cathode or a heater.

The other end of electrode 8 is connected to lead-in wire 5 through a thermally sensitive switch which can comprise a bimetal 9 within a glass bottle 10. Bimetal 9 is normally closed at room temperature and is electrically connected between electrode 8 and lead-in wire 5 by means of wires 11 and 12 which extend through glass bottle 10.

The emissive coating on electrode 8, which is generally a mixture of alkaline earth oxides, is deposited thereon in the form of carbonates. The carbonates are converted to the oxides by heating electrode 8 to an elevated temperature, say, about 1700° C., while a vacuum is maintained in the envelope. This process is called cathode activation and requires about 20 seconds of process time on modern lamp manufacturing equipment. Heating of electrode 8 is accomplished by passing current therethrough by means of lead-in wires 4 and 5. However, a problem occurs in that heat from electrode 8 opens bimetal 9 before the cathode activation process is complete and shuts off current flow to electrode 8, thereby interrupting the activation process.

This invention solves the problem by connecting a wire fuse 13 between wires 11 and 12, thereby shorting out bimetal 9. Thus, opening of bimetal 9 during the activation process does not stop current flow, because fuse 13 carries the activation current. For this purpose, it is advantageous that fuse 13 be made of refractory metal wire. After the activation process has been completed, fuse 13 can be removed from the circuit to render the bimetal switch operative. In one example, wires 11 and 12 consisted of 20 mil dumet wire and wire fuse 13 was a short length of 3 mil molybdenum wire. The 3 mil wire could easily handle the peak activation current of about 1½ amperes. Removal of the 3 mil wire fuse 13 was accomplished by subjecting it to an electrical pulse, for example, from a 270 microfarad capacitor charged to 300 volts dc, which was applied to lead-in wires 4 and 5, while bimetal 9 was open. The pulse melted away fuse 13 and rendered the switch operative.

Since bimetal 9 must be open when fuse 13 is melted (by applying a pulse of current thereto), it is advantageous to melt fuse 13 immediately after the activation process is complete and while bimetal 9 is still open as a result of the heat from electrode 8.

I claim:

1. In the manufacture of a rapid start fluorescent lamp comprising a sealed envelope with an electrode at each end thereof and having a heater current disconnect switch within the envelope proximate to, and in series with, a lamp electrode, the switch being normally closed at room temperature but open at or above a predetermined elevated temperature and wherein the electrode contains a cathode coating that must be heated to a predetermined elevated temperature in order to activate said coating, the process which comprises providing a shorting fuse within the envelope and in parallel with said switch, heating said electrode to the predetermined temperature which activates said coating and which opens said switch as a result of direct heat transfer from the electrode to the switch, and then melting the fuse, while the switch is open, by applying thereto a pulse of electrical current.

2. The process of claim 1 wherein said fuse is melted immediately after completion of the activation step and while the switch is still open as a result thereof.

3. The process of claim 1 wherein said switch comprises a glass enclosed bimetallic element.

4. The process of claim 1 wherein said fuse comprises a short length of refractory metal wire.

5. The process of claim 1 wherein said pulse of electrical current is provided by a charged capacitor.

* * * * *